US009689142B2

(12) United States Patent
Bradley et al.

(10) Patent No.: US 9,689,142 B2
(45) Date of Patent: Jun. 27, 2017

(54) RADIAL PATTERN MECHANICALLY ADJUSTABLE BLADE PITCH MOUNT

(71) Applicant: CNH Industrial America LLC, New Holland, PA (US)

(72) Inventors: Nathan J. Bradley, Muscatine, IA (US); Ryan Ogg, Burlington, IA (US)

(73) Assignee: CNH Industrial America LLC, New Holland, PA (US)

( * ) Notice: Subject to any disclaimer, the term of this patent is extended or adjusted under 35 U.S.C. 154(b) by 27 days.

(21) Appl. No.: 14/713,849

(22) Filed: May 15, 2015

(65) Prior Publication Data

US 2016/0333546 A1 Nov. 17, 2016

(51) Int. Cl.

| | |
|---|---|
| ***E02F 3/78*** | (2006.01) |
| ***E02F 3/76*** | (2006.01) |
| ***E02F 3/815*** | (2006.01) |

(52) U.S. Cl.

CPC ..... *E02F 3/7618* (2013.01); *E02F 3/7645* (2013.01); *E02F 3/8152* (2013.01)

(58) Field of Classification Search

CPC ..... E02F 3/76; E02F 3/7618; E02F 3/7631; E02F 3/7645

USPC ..... 172/818, 824–826

See application file for complete search history.

(56) References Cited

U.S. PATENT DOCUMENTS

| | | | | |
|---|---|---|---|---|
| 2,279,869 | A * | 4/1942 | Houston | E02F 3/8152 172/197 |
| 2,548,350 | A * | 4/1951 | Combs | E04F 21/26 33/469 |
| 2,573,921 | A | 11/1951 | McNamara, Jr. | |
| 2,816,375 | A * | 12/1957 | Anderson | E02F 3/815 172/136 |
| 3,325,924 | A | 6/1967 | Peck, Jr. | |
| 6,354,025 | B1 * | 3/2002 | Kirchell | E01H 5/063 172/816 |
| 6,364,617 | B1 * | 4/2002 | Riske | F04D 29/601 411/400 |
| 8,272,451 | B2 | 9/2012 | Ditzler | |
| 2013/0087351 | A1 | 4/2013 | Sulzer | |

FOREIGN PATENT DOCUMENTS

GB 2491203 A 11/2012

* cited by examiner

*Primary Examiner* — John G Weiss
(74) *Attorney, Agent, or Firm* — Patrick M. Sheldrake

(57) ABSTRACT

A vehicle blade assembly apparatus including a push beam; a blade having a working side and a connection side; an anchoring bracket disposed on the connection side of the blade and having a plurality of mounting bores arranged along an arc around a retention hole; and a pitch link connected to the push beam and to the anchoring bracket using a retention pin configured to be removably placed through co-linear mounting bores on the pitch link and the anchoring bracket.

8 Claims, 4 Drawing Sheets

RADIAL PATTERN MECHANICALLY ADJUSTABLE BLADE PITCH MOUNT

BACKGROUND OF THE INVENTION

1. Field of the Invention

The present invention relates generally to work vehicles having a front blade configured to push materials such as soil, sand, rubble or other debris, and, more particularly, to an apparatus for selectively coupling such a blade mechanism to a work vehicle at multiple pitch angles.

2. Description of the Related Art

Bulldozers having front blades are well known. Generally, the blade is supported by one or more hydraulic cylinders used to push the blade forward and/or alter the pitch of the blade. Other bulldozers have a blade with a static pitch where an operator must disengage and re-engage the blade in order to alter the pitch angle of the blade relative to the frame and/or bulldozer.

In prior art systems for static pitch bull dozers, a single mounting bore is disposed through an anchoring bracket on the rear of the blade and multiple, linearly arranged corresponding mounting bores are disposed on one end of an adjacent pitch link. The pitch of the blade is adjusted by selectively engaging the pitch link with a mounting bore on the mounting bracket. Such systems often include a plurality of retention holes disposed through the anchoring bracket relatively adjacent to the mounting bores.

Other prior art systems can include a plurality of linearly arranged mounting bores through an anchoring bracket on the top of the push beam of the bulldozer. These systems can also have a plurality of retention holes disposed through the anchoring bracket relatively adjacent to the mounting bores.

In both of the above described prior art designs, each retention hole adds to the cost of manufacturing the bulldozer. Additionally, any unused retention holes are open to the elements as the bulldozer is in use. Consequently, the retention holes are susceptible to oxidation which may render the retention hole unusable. Also, systems with mounting bores on the top of the push beam of the bulldozer are more susceptible to damage than arrangements on the back of the blade.

Other prior art bulldozer blade assemblies require the use of an extendable turnbuckle. Extendable turnbuckles also add complexity to the overall design. Moreover, dirt and debris collected while using the bulldozer may negatively impact the functionality of such extendable turnbuckles. The extension mechanism of such turnbuckles is also susceptible to damage from oxidation.

Thus, what is needed is an improved system for selectively mounting a blade at a desired pitch angle on a bulldozer.

SUMMARY OF THE INVENTION

The present invention provides a multiple pitch bulldozer blade mounting system that includes a plurality of mounting bores arranged at a constant distance from a single retention hole.

In one exemplary embodiment, the blade assembly of the present invention includes a push beam; a blade having a working side and a connection side; an anchoring bracket disposed on the connection side of the blade and having a plurality of mounting bores arranged along an arc around a retention hole; and a pitch link connected to the push beam and to the anchoring bracket using a retention pin configured to be removably placed through co-linear mounting bores on the pitch link and the anchoring bracket.

An advantage of the present invention is that a single retention hole may be used on the anchoring bracket thereby obviating the need for multiple retention holes on the anchoring bracket or multiple mounting bores on the top of the push beam which can become damaged to the point of being unusable by debris or oxidation when the bulldozer is in use.

Another advantage of the present invention is that it allows use of a standard cylinder instead of a cylinder with an extended tube for mounting to the top of a push beam with a plurality of mounting holes.

Another advantage is that the present invention increases the overall robustness of the bulldozer attachment mechanism while retaining the ability for an end user to selectively alter the pitch of the blade.

Another advantage of the present invention is that the overall cost of the system design is lower than the presumed cost of prior art products because a device constructed in accordance with the present invention does not require a longitudinally adjustable pitch link in order to achieve multiple pitch angles in the blade.

Still another advantage of the present invention is that the full desired range of pitching angles may be achieved at any blade setting.

BRIEF DESCRIPTION OF THE DRAWINGS

The above-mentioned and other features and advantages of this invention, and the manner of attaining them, will become more apparent and the invention will be better understood by reference to the following description of an embodiments of the invention taken in conjunction with the accompanying drawings, wherein.

Corresponding reference characters indicate corresponding parts throughout the several views. The exemplary embodiment set forth herein is not to be construed as limiting the scope of the invention in any manner.

DETAILED DESCRIPTION OF THE INVENTION

Figure 1:
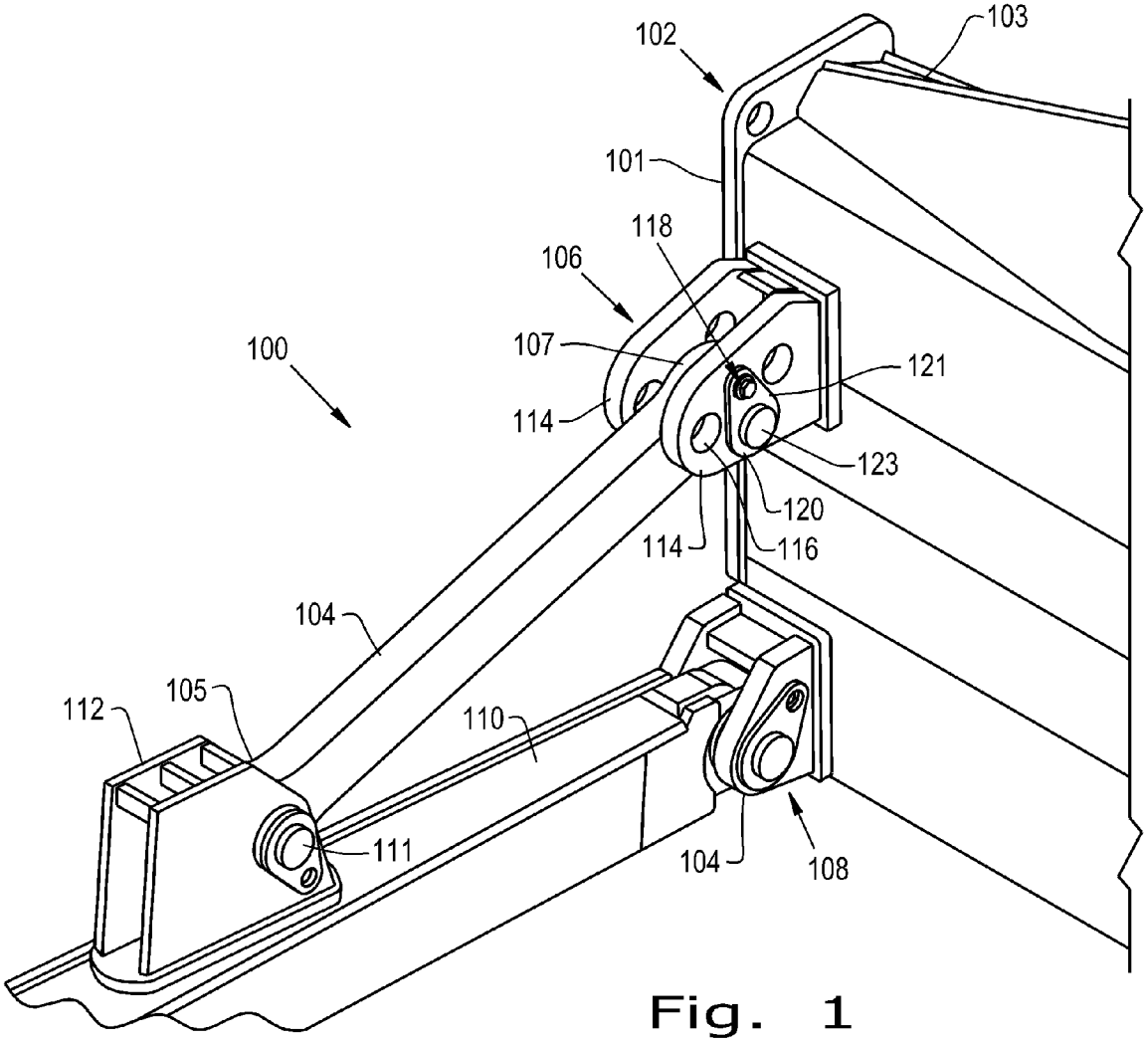
FIG. 1 shows a perspective view of a blade assembly apparatus according to an embodiment of the present invention with the blade attached to the pitch link at a first pitch angle.

Referring now to FIGS. 1-4, there is shown a perspective view of a blade assembly apparatus according to the present invention. As illustrated in FIG. 1, blade assembly apparatus 100 generally includes blade 102; pitch link 104; anchoring bracket 106; additional anchoring bracket 108; and push beam 110.

Push beam 110 has a first end 109 and a second end 111. First end 109 of push beam 110 is pivotally attached to anchor bracket 108, which in turn is rigidly mounted to the connecting side 101 of blade 102. Push beam 110 also has second end 111 fixedly attached to connector 112.

Pitch link 104 includes a first end 105 a second end 107. First end 105 is fixedly, rotatably attached to connector 112, which in turn is mounted to the top side of push beam 110. Second end 107 of pitch link 104 includes a mounting bore (not shown) disposed therethrough. Second end 107 is selectively attached to anchoring bracket 106.

Anchoring bracket 106 is rigidly connected to connecting side 101 of blade 102, and includes a pair of parallel extending arm members 114. At least one arm member 114 of anchoring bracket 106 has a retention hole 118 and at least three mounting bores 116 disposed therethrough (three mounting bores 116 in the embodiment shown). Each mounting bore 116 is disposed along an arcuate path around retention hole 118. In the illustrated embodiment, each mounting bore 116 is disposed about a radius which is equi-distant from retention bore 118.

Figure 2:
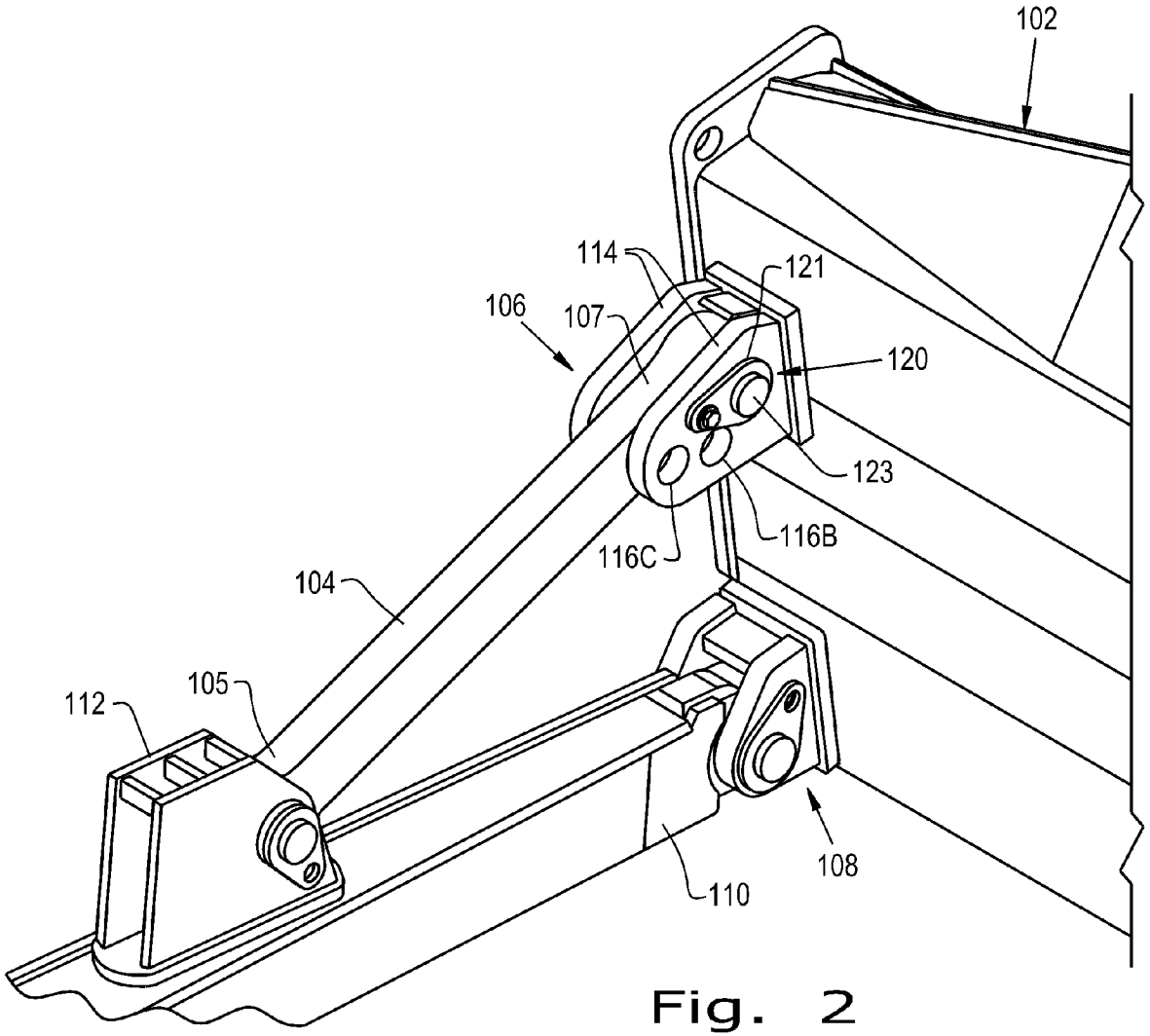
FIG. 2 shows a perspective view of the blade assembly apparatus according to the present invention with the blade attached to the pitch link at a second pitch angle.
Figure 3:
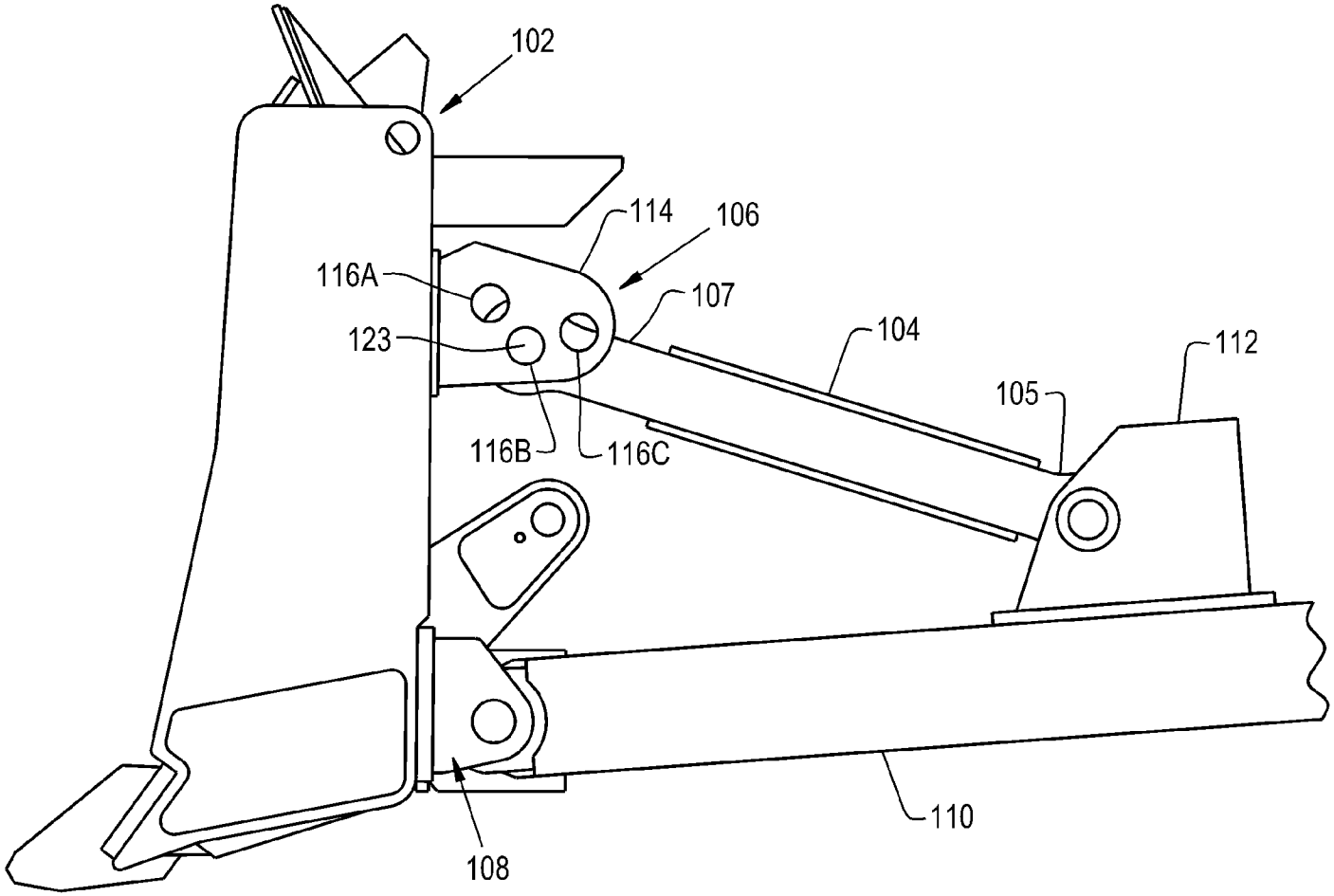
FIG. 3 shows a cross-sectional view of the blade assembly apparatus according to the present invention with the blade attached to the pitch link at the pitch angle shown in FIG. 1.
Figure 4:
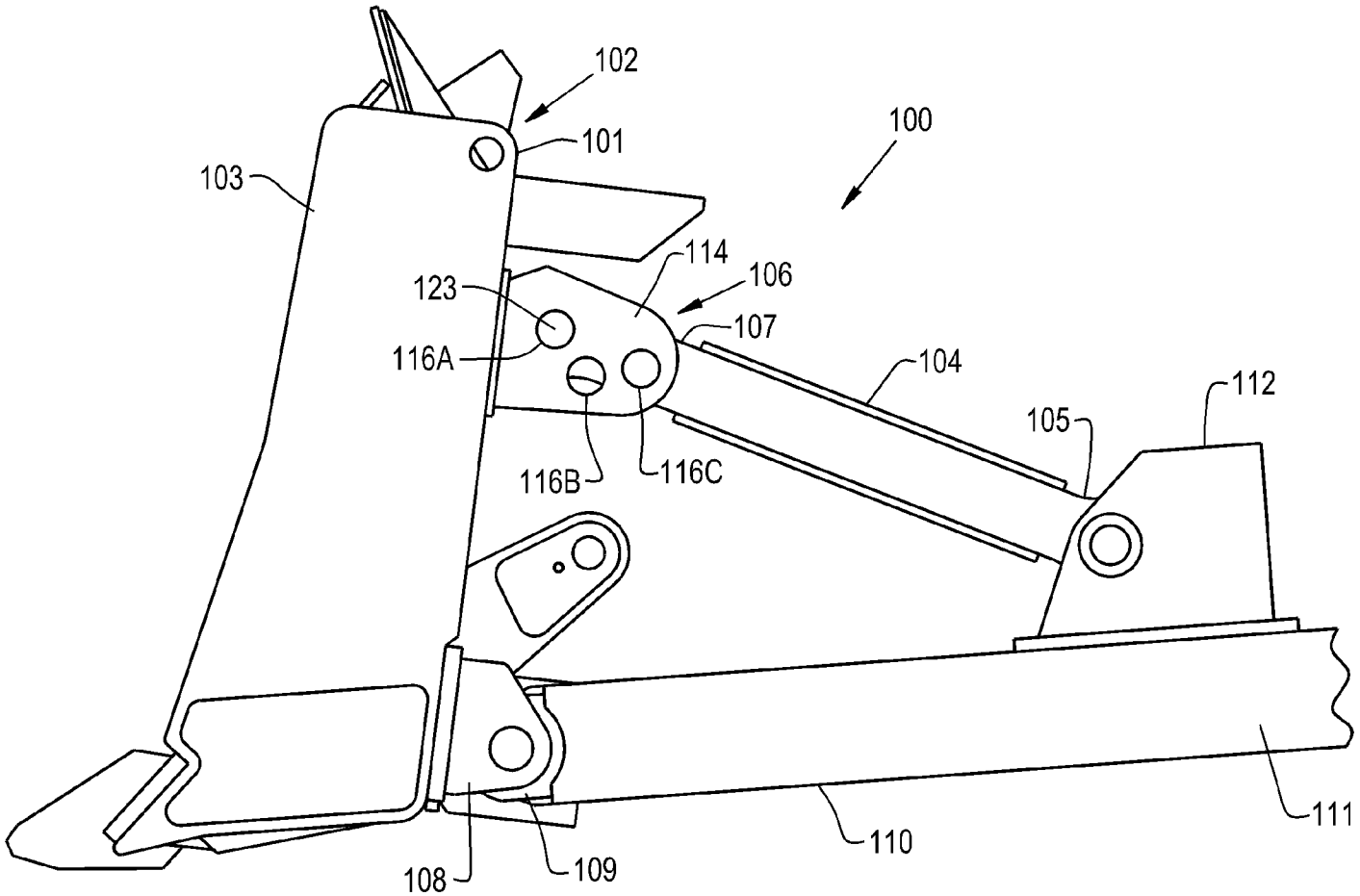
FIG. 4 shows a cross-sectional view of the blade assembly apparatus according to the present invention with the blade attached to the pitch link at the pitch angle shown in FIG. 2.

Retention or "flag" pin 120 is connected to the exterior of upper anchoring bracket 106 and functions to pivotally connect pitch link 104 with a selected mounting bore 116. As shown in FIG. 1, flag pin 120 includes a flag 121 which is integrally connected with a pin 123 which can be selectively disposed through one of the mounting bores 116A, 116B, or 116C and through the bore (not shown) in the second end 107 of pitch link 104. By selectively engaging flag pin 120 into a predetermined mounting bore 116A, 116B, or 116C, the pitch angle of blade 102 relative to pitch link 104 and/or push beam 110 may be changed. FIGS. 2 and 4 show pitch link 104 attached to anchoring bracket 106 of blade 102 at a different pitch angle than that shown in FIGS. 1 and 3. More specifically, FIGS. 1 and 3 show pitch link 104 attached to mounting bore 116B and, FIGS. 2 and 4 show pitch link 104 attached to mounting bores 116A. Pitch link 104 may incorporate a variable length design such as a turnbuckle or cylinder to further alter the dimensions of blade assembly apparatus 100.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A blade assembly apparatus for a vehicle, said blade assembly apparatus comprising:

a push beam;

a blade having a working side and a connection side;

an anchoring bracket disposed on the connection side of said blade and including a retention hole and plurality of mounting bores, said mounting bores arranged along an arc having a single radius about said retention hole;

a pitch link having a first end and a second end, said first end of said pitch link pivotally connected to said push beam and said second end of said pitch link having a mounting bore; and a retention pin configured to be removably disposed through one of said anchoring bracket mounting bores and said pitch link mounting bore, thereby selectively attaching said pitch link to said anchoring bracket wherein the anchoring bracket comprises at least three mounting bores disposed at an equal distance from said retention hole.

2. The blade assembly apparatus of claim 1, wherein the anchoring bracket includes a pair of parallel extending arm members, and the second end of the pitch link is disposed between the arm members.

3. The blade assembly apparatus of claim 2, wherein each said arm member includes the plurality of mounting bores, and said retention pin passes through a pair of aligned said mounting bores in each arm member.

4. The blade assembly apparatus of claim 1, wherein the retention pin comprises a flag pin.

5. The blade assembly apparatus of claim 4, further comprising a bolt disposed through the flag pin and threadably connected to said anchoring bracket.

6. The blade assembly apparatus of claim 1, wherein the pitch link has one of a fixed length and a variable length.

7. The blade assembly apparatus of claim 2, wherein the plurality of mounting bores are oriented generally horizontally.

8. A blade assembly apparatus for a vehicle, said blade assembly apparatus comprising:

a push beam;

a blade having a working side and a connection side;

an anchoring bracket disposed on the connection side of said blade and including a retention hole and plurality of mounting bores, said mounting bores arranged along an arc having a single radius about said retention hole;

a pitch link having a first end and a second end, said first end of said pitch link pivotally connected to said push beam and said second end of said pitch link having a mounting bore; and a retention pin configured to be removably disposed through one of said anchoring bracket mounting bores and said pitch link mounting bore, thereby selectively attaching said pitch link to said anchoring bracket;

wherein the anchoring bracket comprises three mounting bores disposed at an equal distance about said retention hole.

* * * * *